US007306274B2

(12) United States Patent
Renny

(10) Patent No.: US 7,306,274 B2
(45) Date of Patent: Dec. 11, 2007

(54) TOOL WITH OPPOSED PADDLES

(76) Inventor: Graham Charles Renny, Woodhouse Farm, Bodenham, HR1 3LD, Herefordshire (GB)

( * ) Notice: Subject to any disclaimer, the term of this patent is extended or adjusted under 35 U.S.C. 154(b) by 0 days.

(21) Appl. No.: 11/413,713

(22) Filed: Apr. 28, 2006

(65) Prior Publication Data

US 2007/0132258 A1 Jun. 14, 2007

(30) Foreign Application Priority Data

Dec. 8, 2005 (GB) ..... 0524999.0

(51) Int. Cl.
*A01D 11/00* (2006.01)

(52) U.S. Cl. ..... 294/118; 294/50.8; 56/400.12

(58) Field of Classification Search ..... 294/1.3, 294/1.4, 11, 16, 50.8, 118; 56/400.12
See application file for complete search history.

(56) References Cited

U.S. PATENT DOCUMENTS 716,082 A * 12/1902 McKinly ..... 294/118
1,949,452 A * 3/1934 Chadwick ..... 294/118
3,164,945 A * 1/1965 Spencer ..... 56/400.12
3,367,703 A * 2/1968 Pittis ..... 294/16
3,643,410 A * 2/1972 Menning ..... 56/400.12
3,879,079 A * 4/1975 Nicholas ..... 294/1.4
4,037,397 A * 7/1977 Fiorentino ..... 56/400.12
4,606,569 A 8/1986 Dunn et al. ..... 294/118
4,710,998 A * 12/1987 Gast ..... 452/128
5,459,988 A * 10/1995 Glaser ..... 56/400.17
5,551,741 A 9/1996 LaBoccetta ..... 294/7
5,601,323 A 2/1997 Kaiser ..... 294/7
5,727,828 A * 3/1998 Jones ..... 294/50.8
5,881,545 A * 3/1999 Wilson ..... 56/400.12
5,901,993 A 5/1999 Lowery et al. ..... 294/7

FOREIGN PATENT DOCUMENTS

DE 91 14 466.3 2/1992
EP 0 031 280 7/1981

* cited by examiner

*Primary Examiner*—Dean J Kramer
(74) *Attorney, Agent, or Firm*—Harrington & Smith, PC

(57) ABSTRACT

A manually operable tool for grasping solid objects including a scissors assembly at opposed ends of which are a pair of handles, and a pair of opposed paddles such that objects may be received between the paddles whereupon movement of the handles towards each other causes the paddles to move together to grasp the solid objects therebetween.

4 Claims, 4 Drawing Sheets

TOOL WITH OPPOSED PADDLES

FIELD OF THE INVENTION

The invention relates to a manually operable tool for grasping solid articles. In particular although not exclusively, the invention relates to a tool which can enable an operator to transfer the articles without stooping to another location, for example picking up leaves for disposal in a receptacle. The tool is particularly suited to the grasping of objects such as horse droppings or industrial metal waste (swarf), horticultural waste (compost, cuttings, clippings etc.), hospital waste (accident & Emergency or Emergency Room contaminated waste), new potato harvesting and the like.

BACKGROUND TO THE INVENTION

It is known to collect waste material such as horse droppings or swarf using a shovel, the use of which requires some stooping. Leaves are often picked up using a pair of unconnected boards, trapping the leaves between the boards. Again, this requires stooping by the operator. Many human back problems arise from injudicious stooping.

Litter collection has been made easier and stooping obviated by the use of a long pincer-like tool operated from a remote hand grip. This enables items of litter to be picked up without the operator having to stoop. However, the load carrying properties of this kind of device are very limited, and articles generally have to be transferred singly. These devices are essentially for one hand operation, the other hand of an operator being used to hold a receptacle for the litter. These are often used in street cleaning/litter collection circumstances.

SUMMARY OF THE INVENTION

The invention provides a manually operable tool for grasping solid objects comprising a scissors assembly at opposed ends of which are a pair of handles, and a pair of opposed paddles such that objects may be received between the paddles whereupon movement of the handles towards each other causes the paddles to move together to grasp said solid objects therebetween.

The grasped solid objects may be transferred to another location or to a container such as a receptacle.

Preferably each of the paddles has a straight lower edge. More preferably, each of the paddles has a first straight lower edge and a second straight edge disposed at an obtuse angle to said first straight edge.

Advantageously a first one of the paddles may be provided with a comb-like structure at a lower region thereof, and extending in the direction of a second said paddle. Preferably the comb-like structure is disposed such that when the tool is in a closed position, with the paddles close to each other, the comb-like structure extends beneath a second one of the paddles.

Preferably said comb-like structure extends from a region near at least one of said first and second straight edges of said first paddle to extend beyond at least one of said first and second straight edges of said second paddle when the tool is in a closed position. The comb-like structure preferably extends from a region near at least one of said first and second straight edges of said first paddle to extend beyond at least one of said first and second straight edges of said second paddle when the tool is in a closed position.

Preferably at least some fingers of the comb-like structure have ends which are bent upwardly.

The tool can be used by an operator without stooping, the operator being in a straight-backed standing or seated posture.

According to a second aspect of the invention there is provided a manually operable tool for grasping solid objects, the tool comprising a scissors assembly at opposed ends of which are a pair of handles, and first and second opposed paddles, arranged such that objects may be received between the paddles, in which each of the paddles has a straight lower edge and in which the first paddle has a comb-like structure at a lower region thereof and extending towards the second paddle whereupon movement of the handles towards each other causes the paddles to move together to grasp said solid objects therebetween.

Embodiments of the invention will now be described by way of example only with reference to the accompanying drawings.

DETAILED DESCRIPTION OF THE PREFERRED EMBODIMENTS

The tool shown in the figures comprises a scissors assembly shown generally as 10, comprising two links 10*a* and 10*b* linked by a pivot 12. In this embodiment the pivot is not placed mid-way along the limbs but towards lower regions thereof. Each limb 10*a*, 10*b* bears at its lower end a respective paddle 14*a*, 14*b*, the paddles being of laminar form and disposed at right angles to the length of the limbs. The paddles are preferably of a similar size and shape. The paddles comprise stiff or semi-stiff laminar sheets. Each paddle has a first straight edge 16 and a second straight edge 18 meeting the first straight edge 16 at an obtuse angle X. The first straight edge 16 extends generally perpendicularly to the handle 10*a*, 10*b* that it is associated with. Thus, it can be termed a bottom or lower edge since it is bottommost when in use. Edges of the paddles other than the first and second straight edges 16, 18 are curved.

Figure 2:
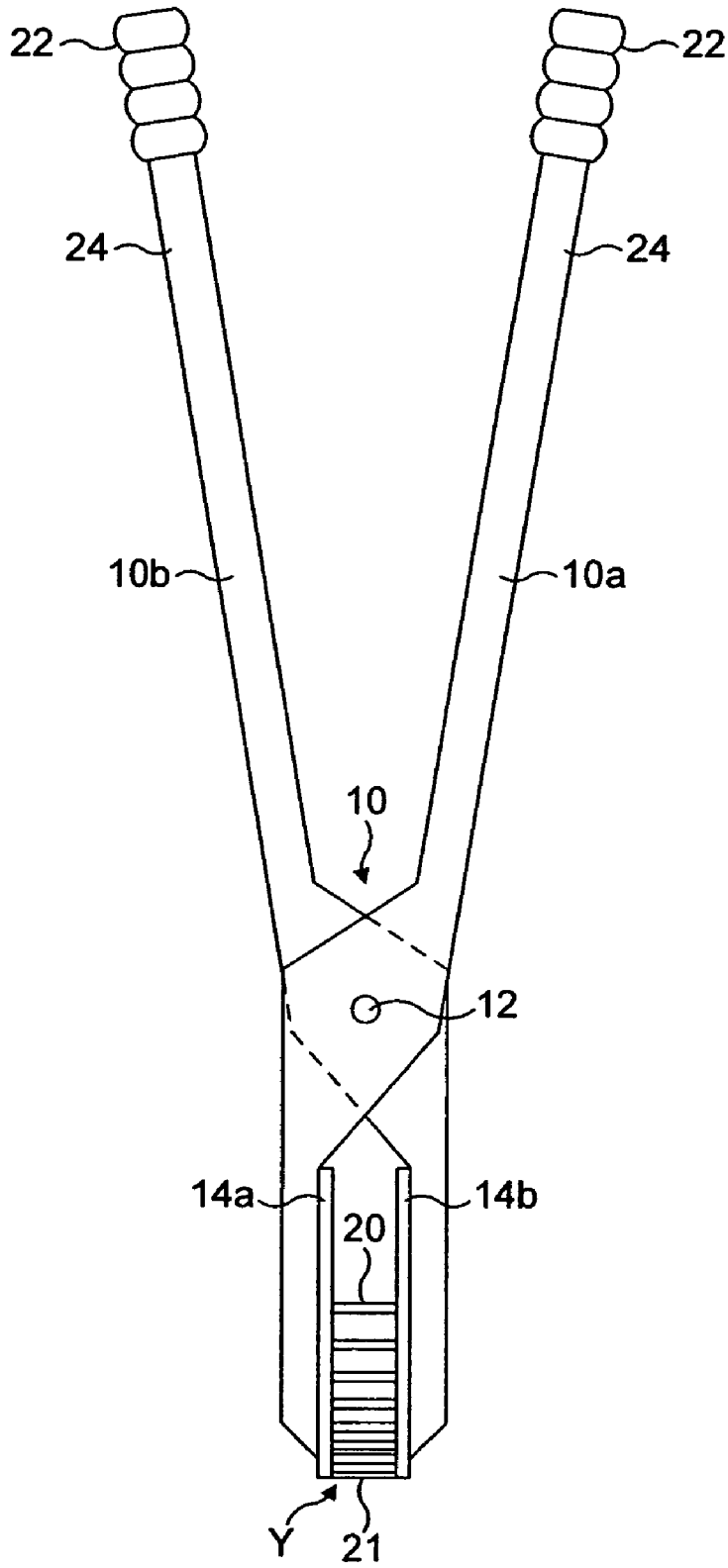
FIG. 2 is a schematic view similar to FIG. 1 showing the said tool in a closed position.
Figure 3A:
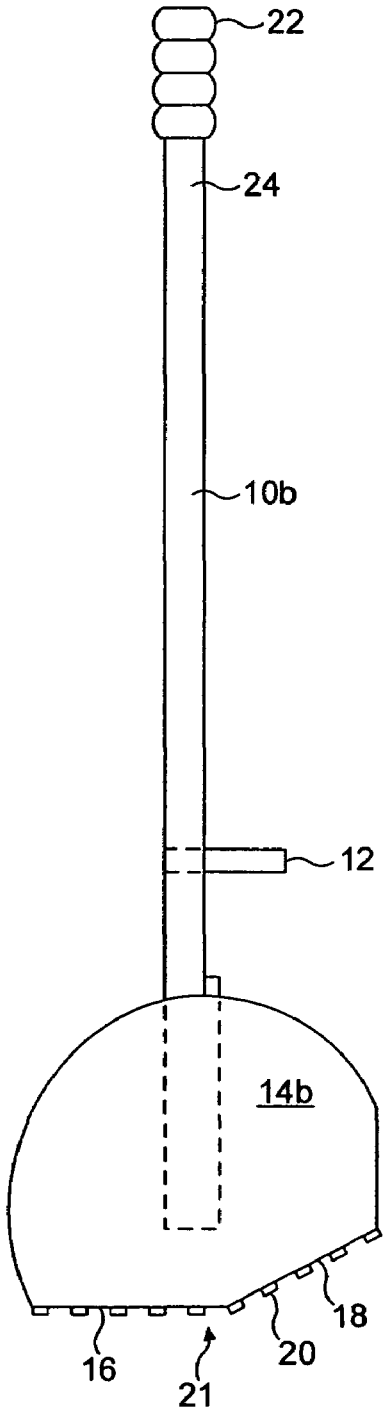
FIGS. 3*a* and 3*b* are schematic views of respective disassembled first and second limbs of the scissor assembly.
Figure 3B:
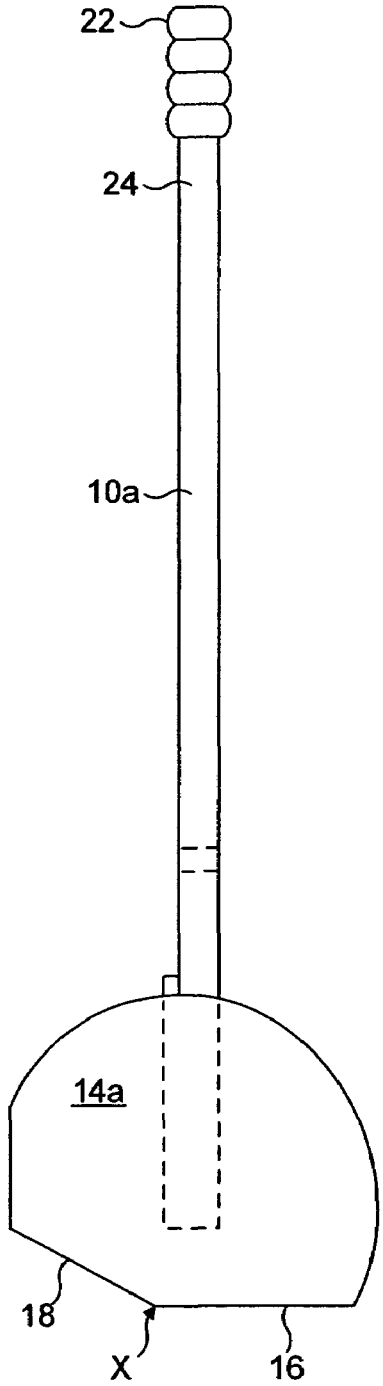

One of the paddles l4*b* is provided at its straight edges 16, 18 with a comb-like structure shown generally as 21 comprising a series of teeth 20 disposed substantially normal to a face of the paddle 14*b* and extending towards the opposed paddle l4*a* such that the comb-like structure underlies the straight edges 16, 18 of the paddle l4*a* as shown in FIG. 2. The length of the opposed paddle l4*a* is such that it passes closely over the fingers of the comblike structure 21. To this end, the first paddle l4*b* may be slightly longer than the opposed paddle 14*a*. Hand grips 22 are provided on handles 24 at ends of the scissor assembly limbs 10*a*, 10*b* remote from the paddles 14*a*, 14*b*.

The tool 10 may be made from any suitable material such as wood, cane, plastics, rubber, metal, or combinations of these.

Figure 1:
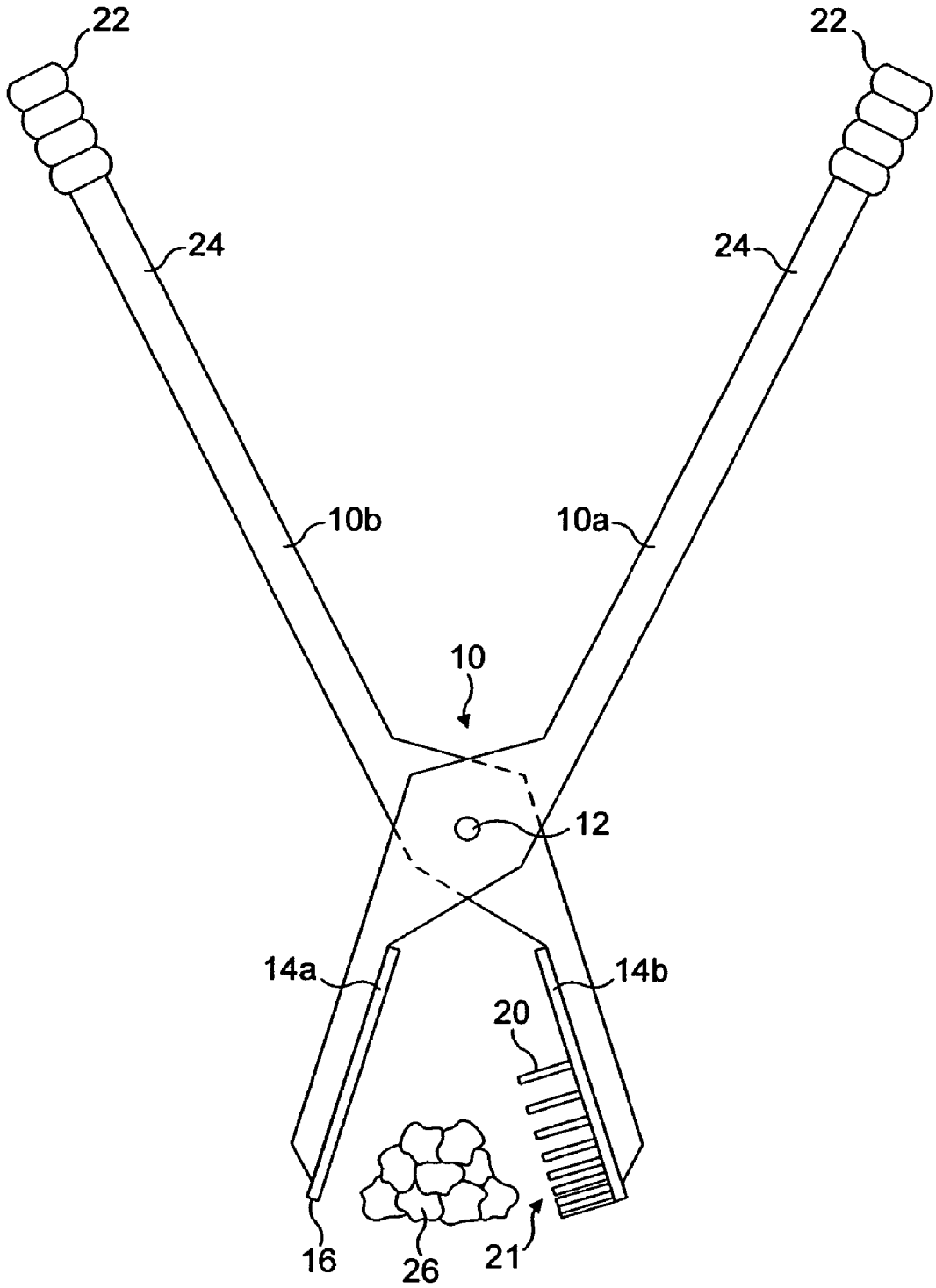
FIG. 1 is a schematic view of a tool according to the invention shown in an open position and as viewed end-on in the direction of a pivot axis of the tool.

In use the paddles 14*a*, 14*b* are first moved apart by an operator moving the handles 24 apart. Each handle 24 is held by a different hand of the operator. Thus, the tool. 10 is a two-handed tool. When the tool 10 is orientated over solid material 26 (FIG. 1) to be grasped, the handles 24 are brought together. This brings the paddles 14*a*, 14*b* together by scissor action, and causes them to grasp the solid material between the paddles. The comb-like structure 21 assists in retaining the solid material between the paddles 14. The tool 10 is then moved so that the solid material is at a different location, for example over the mouth of a receptacle, whereupon the solid material is released. The tool 10 is therefore of great utility in clearing paddocks and stables of horse droppings, and clearing gardens and the like of general debris and waste.

The provision of the first straight edge 16 and the second straight edge 18 provides additional utility to the tool 10. In particular, on a level surface the first straight edge 16 sits flat on the surface when the tool is held vertically. This allows solid material to be removed from the surface very effectively. The second straight edge sits flat on a surface when the tool 10 is held at an angle departing from a line perpendicular to the surface which is equal to the obtuse angle X. This makes the tool 10 easy to use on sloped surfaces and/or with the handles 10*a*, 10*b* held at an angle sloping downwards away from the operator.

Furthermore, the part of the paddles 14*a*, 14*b* where the first and second straight edges 16, 18 meet is able to be used to collect solid material resting in a depression or hollow on a surface.

Figure 4:
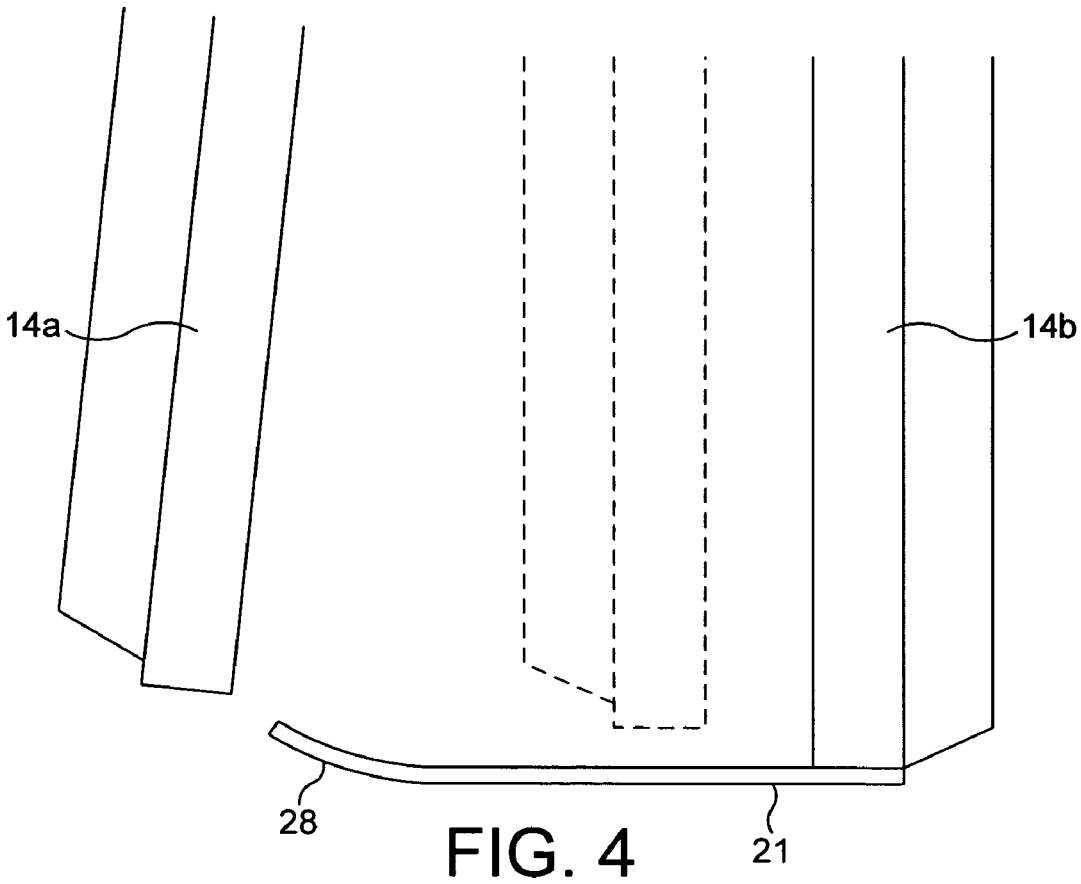
FIG. 4 is a schematic view of ends of paddles of the FIGS. 1 to 3*b* tool in more detail.

As can be seen from FIG. 4, fingers 28 of the comb-like structure 21 are bent upward slightly at their end distal to the paddle 14*b*. This is advantageous since it allows the paddle 14*a* to be moved across a surface whilst resting on that surface. The upwardly bent fingers 28 are less likely to dig into the surface, thereby not impeding movement of the paddle 14*a* across the surface, than fingers not bent upwardly. The extent to which the fingers 28 are bent is slightly exaggerated in the Figure.

FIG. 4 also shows more clearly that the paddles are of slightly different length such that the opposed paddle 14*a* is arranged to be movable over the comb-like structure 21 closely. This allows the paddles to be brought closer together than would be possible if the fingers 28 of the comb-like structure impeded movement of the opposed paddle 14*a*. This is achieved whilst allowing the ends of both paddles 14*a* to 14*b* easily to be brought together whilst both are in close contact with a surface.

Clearly, first and second edges 16, 18 which are generally or substantially straight are similarly effective as edges which are absolutely straight, and references in this specification to 'straight' should be construed accordingly.

As shown in the drawings, the paddles 14*a*, 14*b* are spaced apart by a small distance, for instance a few centimeters, when the paddles 14*a*, 14*b* are parallel to one another. However, any other suitable configuration can be used instead. For instance, the paddles may become parallel to one another only when they are in contact. Alternatively, the paddles may not become parallel to one another regardless of the location of the handles.

It will be apparent that various modifications can be made within the scope of the invention. For instance, the paddles need not be solid but could be perforated in a grid-like manner. Though the desirability of this will depend upon the size of the solid material to be handled (grasped).

Comb-like structures could be provided on both the paddles and arranged such that their teeth interlock alternately. The comb-like structures could be replaced by a solid shelf structure or could be omitted entirely. Whilst the embodiment has been described with reference to the picking up of horse droppings, it will be readily apparent that the invention lends itself to picking up other solid articles such as metal, waste, swarf, compost, potatoes etc.

The tool is typically about 1 meter long but can be longer or shorter to suit the usage. For example, if it is to be used from a seated position then it need only be about 0.8 meters if operated by a user picking up objects from a bench then 0.5 meters.

The tool could be longer if it is desired to use it at a distance, for example at an acute angle and could be up to 2 meters or more.

Instead of the handles diverging when the paddles are closed, the handles may rest against or close to one another when the paddles are closed. This results in the tool 10 occupying a smaller volume when not being used. It can also require less packaging to be used with the tool prior to first sale.

What is claimed is:

1. A manually operable tool for grasping solid objects, the tool comprising:

a scissors assembly;

first and second handles at opposed ends of the scissors assembly; and first and second opposed paddles, such that objects may be received between the first and second paddles whereupon movement of the first and second handles towards each other causes the first and second paddles to move together to grasp said solid objects therebetween, in which the first paddle has a comb-like structure at a lower region thereof and extending towards the second paddle;

each of the first and second paddles has a respective first straight lower edge and a respective second straight edge disposed at an obtuse angle to said first straight edge; and said comb-like structure extends from a region near both of said first and second straight edges of said first paddle to extend beyond both of said first and second straight edges of said second paddle when the tool is in a closed position.

2. A manually operable tool as claimed in claim 1, in which at least some fingers of the comb-like structure have ends which are bent upwardly.

3. A tool as claimed in claim 2, in which the handles substantially meet one another when the tool is in a closed position.

4. A tool as claimed in claim 1, in which the handles substantially meet one another when the tool is in a closed position.

* * * * *